United States Patent [19]

Pallone et al.

[11] Patent Number: 4,990,192

[45] Date of Patent: Feb. 5, 1991

[54] METHOD OF REMOVING LINT, HAIR AND OTHER PARTICULATE MATTER FROM FABRIC

[75] Inventors: Thomas J. Pallone, South Barrington; Larry J. Alania; William C. Weber, Jr., both of Naperville; Robert F. Farmer, Barrington, all of Ill.

[73] Assignee: Alberto-Culver Company, Melrose Park, Ill.

[21] Appl. No.: 421,641

[22] Filed: Oct. 16, 1989

[51] Int. Cl.[5] ..... B08B 7/00

[52] U.S. Cl. ..... 134/4; 134/6; 134/42; 428/355

[58] Field of Search ..... 134/6, 10, 42, 4; 428/291, 147, 327, 290, 355

[56] References Cited

U.S. PATENT DOCUMENTS

| | | | |
|---|---|---|---|
| 1,468,380 | 9/1923 | French | 428/291 X |
| 2,759,860 | 8/1956 | Pallos | 134/6 |
| 3,305,510 | 2/1967 | Gander | 524/378 |
| 3,305,513 | 2/1967 | Gander | 524/378 X |
| 3,400,095 | 3/1967 | Kremer et al. | 260/32.8 |
| 3,682,690 | 8/1972 | Amos et al. | 134/10 |
| 3,754,991 | 8/1973 | Amos et al. | 134/4 |
| 4,497,919 | 2/1985 | Varga et al. | 524/10 |
| 4,510,640 | 4/1985 | Omori | 15/104 A |
| 4,713,274 | 12/1987 | Minor | 428/40 |
| 4,810,407 | 3/1989 | Sandvick | 252/90 |
| 4,820,558 | 4/1989 | Sundberg | 428/40 |

*Primary Examiner*—Patrick P. Garvin
*Assistant Examiner*—George R. Fourson

[57] ABSTRACT

A novel method is provided for removing lint, hair, and other particulate matter from fabric articles such as clothing, upholstery, or draperies. A sprayable aerosol adhesive composition is applied to flexible sheet material, such as a paper towel, so as to splatter the surface of the sheet with tacky adherent globules of a tackified or plasticized resin without forming a continuous coating on the surface. The sprayed surface of the sheet is ready within 60 seconds for contacting with the fabric from which the particulate matter is to be removed.

17 Claims, No Drawings

METHOD OF REMOVING LINT, HAIR AND OTHER PARTICULATE MATTER FROM FABRIC

FIELD OF THE INVENTION

The field of this invention is the removal of particulate matter such as lint or hair from fabric other than by washing or dry cleaning. Methods and devices within the field of the invention include those which can be employed for quick removal of particulate matter from the surface of a garment while the garment is being worn or immediately prior thereto.

BACKGROUND OF THE INVENTION

It is known to impregnate or coat cloth, paper, or other sheet material with a tacky adhesive, and to applying the impregnated or coated sheet material to a garment from which it is desired to remove lint or hair. Illustrative U.S. Pat. Nos. include 1,468,380, 3,682,690, 4,557,011, 4,575,890, and 4,713,274. As described in U.S. Pat. No. 3,682,690, a roller may be coated with a tacky elastomer which is water-washable, thereby permitting the particulate matter collected by the roller to be removed by washing. U.S. Pat. Nos. 4,557,011 and 4,575,890 utilize a series of separately detachable adhesive sheets which are supported on a roller for applying to the garment. After the outer sheet on the roll has picked up the lint or hair, it then must be removed, exposing a fresh sheet.

U.S. Pat. No. 4,713,274 describes a pad having a plurality of removable sheets which are coated with an adhesive material for use in collecting particulate matter. U.S. Pat. No. 4,820,558 describes an envelope formed from plastic sheets having the outer surfaces of the sheets coated with an adhesive material suitable for collecting particulate matter. A hand may be inserted within the pocket formed by the sheets for applying the device.

As far as is known, no one has heretofore proposed the use of an aerosol adhesive spray for removing particulate matter. U.S. Pat. No. 2,759,860 describes a lint removing process in which a liquid composition is applied to the bristles of a brush or whisk broom. The brush or whisk broom after coating with the composition is brushed over the surface of the garment.

Aerosol adhesive formulations are known. In general, they consist of a film-forming resin, a tackifier or plasticizer therefor, and an aerosol propellant in which the resin is soluble or readily dispersible. On application to sheet material, such as the backs of photographs, the spray forms a tacky, adherent coating. Such formulations include acrylic polymers such as the methacrylate polymers employed with volatile aerosol propellants as disclosed in U.S. Pat. No. 3,305,510. As there described, the alkyl acrylate polymer may be modified so that it is water-washable to facilitate removal of misapplied spray. The patent indicates that dimethyl ether can function both as a propellant and solvent for acrylate polymers. U.S. Pat. No. 3,400,095 describes an aerosol-packaged spray adhesive formulated from an elastomeric polymer together with a tackifier resin. The spray composition is intended to form a tacky coating.

SUMMARY OF INVENTION

In the development of this invention, it was found that a tacky aerosol adhesive spray can be employed for removing lint, hair, or other particulate matter from garments or other fabric surfaces providing the spray is formulated in accordance with certain criteria and is used in a defined manner. In formulating the sprayable adhesive composition, the film-forming resin together with a tackifier or plasticizer therefor should be dissolved or dispersed in a volatile aerosol propellant. More specifically, the propellant should be sufficiently volatile so that it evaporates very rapidly from the sprayed droplets, either in transit or immediately after the droplets are deposited. Furthermore, the spraying of the composition should be carried out so as to splatter the surface of the substrate with tacky adherent globules of the tackified or plasticized resin without forming a continuous coating on the surface.

Since film-forming resins readily produce coatings and have typically been employed for this purpose, a very brief spraying time is required to produce the desired relatively discrete adherent globules. Spray times of as little as 1 to 5 seconds have been found to be advantageous. In fact, the most effective spray time for producing a globular-type surface coating is in the range of 2 to 4 seconds.

The rough, globular-type coating produced by the method of this invention has been found to be especially suitable for removal of lint and hair from garments or other fabric articles, such as upholstery or draperies. The globules can be deposited in less than five seconds and are ready for use in less than 30 seconds. The deposited tacky globules are adherent to the substrate to which they are applied, and are sufficiently free of solvent that they can be contacted with a cloth garment without transfer to the garment. The relatively rough tacky surface is especially effective in picking up lint or hair.

An advantage of the method of this invention is that it can be employed with readily available substrates such as paper towels. Although a paper towel is highly absorbent, because of the limited amount of spray applied and the deposit of the spray in the form of droplets or globules, the deposited adhesive material remains on the surface of the towel paper and thereby functions effectively for removal of hair or lint. Other absorbent sheet material can be used, such as cloth. Sheet material subject to shedding, such as face or toilet tissue is not desirable. Both absorbent and non-absorbent substrates can be employed, including polyethylene bags, waxed paper, aluminum foil cloth, paper towel, etc.

In the event of misapplication of the sprayed composition, such as on the hands, or unintentional application to a garment, it is desirable to have the tackified or plasticized resin readily water-washable. To accomplish this, the resin can be modified to provide water-solubility. Alternatively, and preferably, a surfactant is incorporated in the formulation to promote water-removability.

Preferred formulations for the purpose of this invention utilize acrylic polymers as the film-forming resin, with tackifiers therefor, such as rosin-type tackifiers. In one preferred embodiment, the sole propellant is dimethyl ether. In other embodiments, the propellant system comprises a mixture of dimethyl ether and a hydrocarbon propellant of suitable volatility such as n-butane, isobutane, propane, or mixtures thereof.

In forming the desired type of deposit on the substrate to which the composition is applied, it has been found advantageous to utilize the resin in the form of aqueous latex emulsion. Excellent results are obtained with an acrylic latex emulsion. Anhydrous compositions can also be used, such as those employing organic solvent solutions of the resin. With anhydrous formulations, it is especially important to control the spraying of the composition in order to achieve globular surface deposit and to avoid the formation of a continuous coating.

DETAILED DESCRIPTION

In carrying out the method of this invention, a sprayable adhesive composition is prepared in a valve-equipped aerosol container. The composition comprises an adhesive film-forming resin in admixture with a tackifier or plasticizer therefor, and a volatile aerosol propellant in which the tackified or plasticized resin and or rosin is soluble or readily dispersible. The packaged composition is sprayed from the container onto flexible sheet material providing an essentially non-shedding surface for receiving the spray. Importantly, the spraying is carried out so as to splatter the surface with tacky adherent globules of the tackified or plasticized resin without forming a continuous coating on the surface. As soon as the globules are essentially free of the propellant, preferably in less than 30 to 60 seconds after application, the surface of the sheet material is contacted with the fabric from which the particulate matter is to be removed. This method has particular application to clothing, upholstery, drapes and other fabric articles which have collected lint, hair, or other detachable particulate matter.

Film-forming resins of the kind which have heretofore been employed for aerosol adhesive compositions can be used. Such resins include acrylic polymers and copolymers. For example, alkyl acrylate or alkyl methacrylate polymers can be used. Elastomeric resins can also be used, such as polyvinylpyrrolidone, vinyl acetate/crotonic acid/vinyl neodeconate copolymers, butyl esters of poly(methylvinyl ether/maleic acid), etc. Such resin polymers are available commercially from a number of sources, as indicates subsequently. Acrylic polymers are preferred and may be used either as an aqueous latex emulsion or as an organic solvent solution. It has been found that acrylic latex emulsions are advantageous in producing a coating in the form of a splattered globules which remain on the surface of even highly absorbent substrates such as towel paper. Organic solvent solutions of acrylic polymers in essentially anhydrous compositions can also be used, providing that the spraying is carefully controlled to produce the desired type of deposit.

For purpose of the present invention, it will usually be desirable to employ a tackifier or plasticizer in combination with the film-forming resin. The sprayed globules should have tacky adhesive character. Rosin-type tackifiers are useful for this purpose, such as rosin polyol esters, modified tall oil rosins, glycerol esters of resin, etc. In certain embodiments, the tackifier may itself be a modified film-forming resin, such as modified acrylics which function as tackifiers.

The propellant or propellant systems should be selected to provide rapid evaporation on spraying of the composition. The individual propellant or the components of a mixture should each have a volatility producing a vapor pressure of 10 psig or higher at 70° F. Preferred solvents are dimethyl ether, or a mixture of dimethyl ether with a hydrocarbon propellant such as propane, n-butane, isobutane, or mixtures thereof. For example, the mixed propellant may contain from 30 to 75 parts by weight of a butane propellant (preferably n-butane) together with 70 to 25 parts of dimethyl ether. Such combinations may produce a lower cost propellant, but for some optimized embodiments it is preferred to employ dimethyl ether as the sole propellant, especially with acrylic latex emulsions. Anhydrous systems using organic solvent solutions of acrylic polymers as copolymers (e.g., acrylic vinyl copolymers) can be used more effectively with combinations of dimethyl ether and hydrocarbon propellants. When permitted by applicable governmental regulations, chlorofluoroalkanes can be employed as full or partial substitutes for dimethyl ether. Such propellants include chlorodifluoromethane and dichlorofluoromethane. The propellant system should also act as an effective solvent for the other ingredients, especially the resin and tackifier. However, a single phase system is not essential if the phases are readily redispersible on shaking the container. It is desired to dispense an essentially homogeneous composition.

To promote water-washability of the applied composition (free from propellant/solvent), a surfactant is preferably incorporated in the aerosol formulation. Suitable surfactants include sorbitan monolaurate, alkylbenzene sulfonate, octylphenoxy polyethoxyethanol, and similar surfactants.

A general formulation of the aerosol compositions for use in this invention can be represented as follows:

| General Formulation | |
|---|---|
| Ingredients | Parts by Wt. |
| Film-forming resin | 1.00 to 12.00 (100% solids) |
| Tackifier/Plasticizer | 1.00 to 7.00 |
| Propellant/Solvent | 78.00 to 99.00 |
| Surfactant | 0.30 to 3.00 |

Preferred compositions based on acrylic polymers are set out below, Composition A using an acrylic polymer latex, and Composition B being an anhydrous formulation.

| Preferred Composition A | |
|---|---|
| Ingredients | Parts by Wt. |
| Acrylic Polymer Latex (50% aqueous) | 4.00 to 10.00 |
| Rosin and/or Modified Acrylic Tackifier | 1.23 to 2.33 (100% solids) |
| Dimethyl Ether | 30.00 to 87.00 |
| n-Butane | 0.00 to 55.00 |
| Surfactant | 0.77 to 2.00 |

To avoid the possibility of corrosion, it is usually not desirable to employ tinplate aerosol containers with formulations like Composition A which contain moisture. With such non-anhydrous compositions the containers can be made of aluminum. Tinplate containers are less expensive than aluminum containers. This can provide a cost advantage for formulations like Composition B. However, formulations like Composition A have the functional advantage of more controllably producing a globular-type spray deposition.

The method of this invention can be practiced with a variety of flexible sheet materials which can provide essentially non-shedding surfaces for receiving the spray. Towel paper is a preferred substrate because of its ready availability and because the absorbent character of the paper does not interfere with the production of the desired globular-type coating if carried out in accordance with the method steps of this invention. Other readily available substrates include polyethylene bags, such as sandwich or food storage bags, as well as other non-absorbent sheet material like waxed paper, aluminum foil, etc. Alternatively, cloth formed from cotton, wool, or synthetic fibers can be used as a substrate.

In applying the aerosol composition to the substrate, a short spray time should be used in order to promote an uneven, globular, discontinuous surface deposit. For example, at spray distances of from 8 to 12 inches, spraying times of 1 to 5 seconds are employed for up to each square foot of sprayed area. For example, a paper towel sheet having a surface area of up to about one square foot can be used. More specifically, at a normal spray distance of 8 to 10 inches, a spray time of 2 to 4 seconds produces the surface deposition desired for use in removing lint or hair from fabric.

Because of the volatility of the propellant/solvent, it largely dissipates in transit. Residual solvent substantially evaporates in 30 to 60 seconds following deposition. In preferred embodiments, the substrate is ready for use in less than 30 seconds following the deposition.

If the length of the spraying time is increased beyond 5 seconds, there is a greater tendency for the deposited film-forming composition to produce a continuous coating. Such coatings may contain residual solvent which will tend to promote absorption of the coating by absorbent substrates such as towel paper. Further, when applied to non-absorbent surfaces such as polyethylene bags, there is a greater tendency for the deposited material to transfer to the garment being treated. It is desirable to avoid spray applications which produce continuous coatings as the spray is deposited.

If on use of a deposit-bearing substrate it is found to be insufficiently tacky or to have an insufficient amount of deposited globules for effective removal of lint or hair, the substrate can be resprayed providing the spraying limitations above are followed.

Formulations for use in practicing the method of this invention are further illustrated by the following examples. Commercial sources of the ingredients are keyed by reference letters to a later presented table. Examples 1 to 4, 6 to 8, and 13 are latex emulsion formulations. Examples 5 and 9 to 12 are anhydrous formulations.

EXAMPLE 1

| Ingredients | % w/w |
|---|---|
| Concentrate: | |
| Ucar 175 (Acrylic Polymer Latex) (50% Aqueous)[a] | 8.940 |
| Duro-Tak 80-1211 (Modified Acrylic (Solution) (44% Solids)[b] | 5.078 |
| Unitac R40 (Rosin Polyol Ester)[c] | 0.080 |
| Triton X100 (Octylphenoxy Polyethoxy-ethanol)[d] | 0.894 |
| Isopropanol | 0.008 |
| Propellant/Solvent: | |
| Dimethyl Ether[e] | 85.000 |
| | 100.000 |

Manufacturing Procedure

Charge manufacturing tank with Duro-Tak. Begin mixing. Add Unitac/IPA blend. Add Triton. Increase mixer speed. Slowly add Ucar 175. Adjust to pH=7.00 with TEA.

Charge a 53 mm×184 mm aluminum aerosol container with 31.8 grams of above blended concentrate. Add 180.2 grams Dimethyl Ether propellant to a pressure of 63–80 psig.

EXAMPLE 2

| Ingredients | % w/w |
|---|---|
| Concentrate: | |
| Ucar 175 (Acrylic Polymer Latex) (50% Aqueous)[a] | 10.000 |
| Duro-Tak 80-1211 (Modified Acrylic Solution)[b] | 2.840 |
| Triton X100 (Octylphenoxy Polyethoxy-ethanol)[d] | 2.000 |
| Propellant/Solvent: | |
| Dimethyl Ether[e] | 85.160 |
| | 100.000 |

Manufacturing Procedure

Charge manufacturing tank with Duro-Tak. Begin mixing. Add Triton. Increase mixer speed. Slowly add Ucar 175.

Charge a 38 mm×107 mm aluminum aerosol container with 11.9 grams of above blended concentrate. Add 68.1 grams Dimethyl Ether propellant to a pressure of 63–80 psig.

EXAMPLE 3

| Ingredients | % w/w |
|---|---|
| Concentrate: | |
| Ucar 175 (Acrylic Polymer Latex) (50% Aqueous)[a] | 7.747 |
| Duro-Tak 80-1211 (Modified Acrylic Solution)[b] | 4.401 |
| Triton X100 (Octylphenoxy Polyethoxy-ethanol)[d] | 0.775 |
| Unitac R40 (Rosin Polyol Ester)[c] | 0.077 |
| Propellant/Solvent: | |
| Dimethyl Ether[e] | 87.000 |
| | 100.000 |

Manufacturing Procedure

Charge manufacturing tank with Duro-Tak. Begin mixing. Add Unitac. Add Triton. Increase mixer speed. Slowly add Ucar 175.

Charge a 45 mm×165 mm aluminum aerosol container with 18.1 grams of above blended concentrate. Add 120.9 grams Dimethyl Ether propellant to a pressure of 63–80 psig.

EXAMPLE 4

| Ingredients | % w/w |
|---|---|
| Concentrate: | |
| Ucar 175 (Acrylic Polymer Latex) (50% Aqueous)[a] | 8.8262 |
| Duro-Tak 80-1211 (Modified Acrylic Solution)[b] | 5.0702 |
| Unitac R40 (Rosin Polyol Ester)[c] | 0.1113 |
| Unirez 1085 (Zinc Resinate)[c] | 0.1000 |
| Triton X100 (Octylphenoxy Polyethoxy-ethanol)[d] | 0.8923 |
| Propellant/Solvent: | |
| Dimethyl Ether[e] | 85.0000 |

-continued

| Ingredients | % w/w |
|---|---|
| | 100.0000 |

Manufacturing Procedure

Charge manufacturing tank with Duro-Tak. Begin mixing. Add Unitac, Triton. With increased mixer speed slowly add Ucar 175. Adjust to pH=7.00 with TEA.

Following Example 3, charge 31.6 grams of above concentrate into a 53 mm×184 mm aluminum aerosol container. Add 0.2 grams amount of Unirez into the aerosol container. Add 180.2 grams of Dimethyl Ether propellant to a pressure of 63–80 psig.

EXAMPLE 5

| Ingredients | % w/w |
|---|---|
| Concentrate: | |
| Trichloroethane | 8.000 |
| Escorez 2520 (Petroleum Hydrocarbon Resin)[f] | 4.000 |
| Duro-Tak 80-1211 (Modified Acrylic Polymer)[b] | 4.000 |
| Triton X100 (Octylphenoxy Polyethoxy-ethanol)[d] | 2.000 |
| Propellant/Solvent: | |
| Dimethyl Ether[c] | 82.000 |
| | 100.000 |

Manufacturing Procedure

Pre-mix Trichloroethane, Duro-Tak, Escorez. Add Triton.

Charge a 53 mm×184 mm aluminum aerosol container with 38.2 grams of above blended concentrate. Add 173.8 grams Dimethyl Ether propellant to a pressure of 63–80 psig.

EXAMPLE 6

| Ingredients | % w/w |
|---|---|
| Concentrate: | |
| Trichloroethane | 4.167 |
| Cascorez E-5317 (Resin Emulsion) (55% Aqueous Solution)[g] | 8.333 |
| Unitac R100 (Pentaerythritol Rosin Ester)[c] | 4.167 |
| Triton X100 (Octylphenoxy Polyethoxy-ethanol)[d] | 1.961 |
| Propellant/Solvent: | |
| Dimethyl Ether[c] | 81.372 |
| | 100.000 |

Manufacturing Procedure

Dissolve Unitac R-100 in Trichloroethane. Add above solution to Cascorez with mixing. Add Triton X-100.

Charge a 59 mm×218 mm aluminum aerosol container with 57.2 grams of above blended concentrate. Add 249.8 grams Dimethyl Ether propellant to a pressure of 63–80 psig.

EXAMPLE 7

| Ingredients | % w/w |
|---|---|
| Concentrate: | |
| Ucar 175 (50%) (Acrylic Polymer Latex) (50% Aqueous)[a] | 8.900 |
| Duro-Tak 80-1211 (44%) (Modified Acrylic Solution)[b] | 5.000 |
| Unitac R40 (90% in Isopropanol( (Rosin Polyol Ester) | 0.100 |
| Triton X-100 (Octylphenoxy Polyethoxy-ethanol)[d] | 0.800 |
| Triethanolamine | 0.200 |
| Propellant/Solvent: | |
| Dimethyl Ether[c]/n-Butane[k] (80/20 wt./wt.) | 85.000 |
| | 100.000 |

Manufacturing Procedure

Charge manufacturing tank with Duro-Tak. Begin mixing. Add Unitac R40. Add Triton X-100. Increase mixer speed. Slowly add Ucar 175. Adjust to pH=7.00 with Triethanolamine.

Charge a 53 mm×184 mm aluminum aerosol container with 31.8 grams of above blended concentrate. Add 180.2 grams of the preblended propellant mixture to a pressure of 60–80 psig.

EXAMPLE 8

| Ingredients | % w/w |
|---|---|
| Concentrate: | |
| Ucar 175 (50%) (Acrylic Polymer Latex) (50% Aqueous)[a] | 8.900 |
| Duro-Tak 80-1211 (44%) (Modified Acrylic Solution)[b] | 5.000 |
| Unitac R40 (90% in IPA) (Rosin Polyol Ester) | 0.100 |
| Triton X-100 (Octylphenoxy Polyethoxy-ethanol)[d] | 0.800 |
| Triethanolamine | 0.200 |
| Propellant/Solvent: | |
| Dimethyl Ether[c] | 30.000 |
| n-Butane[k] | 55.000 |
| | 100.000 |

Manufacturing Procedure

Charge manufacturing tank with Duro-Tak. Begin mixing. Add Unitac R40. Add Triton X-100. Increase mixer speed. Slowly add Ucar 175. Adjust to pH=7.00 with Triethanolamine.

Charge a 53 mm×184 mm aluminum aerosol container with 31.8 grams of above blended concentrate. Add 63.6 grams Dimethyl Ether propellant. Then add 116.6 grams n-Butane propellant to a final pressure of 40–60 psig.

EXAMPLE 9

| Ingredients | % w/w |
|---|---|
| Concentrate: | |
| Aroset 1716-Z-66 (Acrylic Vinyl CoPolymer)[h] | 7.500 |
| Indopol H-1500 (Polybutene)[i] | 1.000 |
| Sandopan LS-24 (Sodium Laureth-13 Carboxylate)[j] | 0.500 |
| Propellant/Solvent: | |

-continued

| Ingredients | % w/w |
|---|---|
| n-Butane[k]/Dimethyl Ether (59/41 Blend) | 91.000 |
| | 100.000 |

Manufacturing Procedure

Following the above recipe, 0.63 oz. of concentrate blended together in the order indicated is added to a 29 lb/20 lb tinplate aerosol container of 202×700 dimensions. The propellant blend (6.37 oz.) is charged to the container using a standard aerosol filling technique.

EXAMPLE 10

| Ingredients | % w/w |
|---|---|
| Concentrate: | |
| Aroset 1716-Z-66 (Acrylic Vinyl Copolymer)[h] | 9.000 |
| Indopol H-1500 (Polybutene)[i] | 1.000 |
| Sandopan LS-24 (Sodium Laureth-13 Carboxylate)[j] | 0.500 |
| Aroset 1845-Z-45 (Acrylic Polymer)[h] | 1.000 |
| Propellant/Solvent: | |
| n-Butane[k]/Dimethyl Ether (41/59 Blend) | 88.500 |
| | 100.000 |

Manufacturing Procedure

Following the above recipe, 0.35 oz. of concentrate blended together in the order indicated is added to a 20 lb/20 lb tinplate aerosol container of 202×406 dimension. The propellant blend (2.65 oz.) is charged to the valved container.

EXAMPLE 11

| Ingredients | % w/w |
|---|---|
| Concentrate: | |
| Aroset 1710-Z-66 (Acrylic Vinyl Co-Polymer)[h] | 7.50 |
| Indopol H-1500 (Polybutene)[i] | 1.00 |
| Triton X100 (Octylphenoxy Polyethoxy-ethanol)[d] | 0.50 |
| Ucar Latex 175 (Acrylic Latex)[a] | 1.50 |
| Propellant/Solvent: | |
| n-Butane[k]/Dimethyl Ether (58/42 Blend) | 89.50 |
| | 100.00 |

Manufacturing Procedure

Following the above recipe, 1.25 oz. of concentrate blended together in the order indicated is added to a 20 lb/20 lb tinplate aerosol container of 207.5×701 dimension. The propellant blend (10.75 oz.) is charged to the valved container.

EXAMPLE 12

| Ingredients | % w/w |
|---|---|
| Concentrate: | |
| Toluene[l] | 9.30 |
| Wingtack Plus (Modified Polyterpene Hydrocarbon Resin)[m] | 2.00 |
| Kraton 1107 (Styrene-Isoprene-Styrene Block Copolymer)[n] | 2.66 |
| Wingstay L (4-Methylphenol Reaction Products with Dicyclopentadiene and Isobutylene)[m] | 0.04 |
| Propellant/Solvent: | |
| n-Butane[k] | 86.00 |
| | 100.00 |

Manufacturing Procedure

Following the above recipe, 0.98 oz. of concentrate is charged to a 202×700 tinplate container. Propellant (6.02 oz.) is charged in the usual manner.

EXAMPLE 13

| Ingredients | % w/w |
|---|---|
| Concentrate: | |
| Ucar 175 (Latex)[a] | 8.9330 |
| Duro-Tak 80-1211 (Modified Acrylic Solution)[b] | 5.0740 |
| Unitac R40 (Rosin Polyol Ester)[c] | 0.1114 |
| Triton X100 (Octylphenoxy Polyethoxy-ethanol)[d] | 0.8930 |
| Mazon R17A (68% Solids)[c] | 0.7000 |
| Triethanolamine | 0.2000 |
| Propellant/Solvent: | |
| Dimethyl Ether[c] | 84.0886 |
| | 100.0000 |

Manufacturing Procedure

Charge manufacturing tank with Duro-Tak. Begin mixing. Add Unitac R40. Add Triton. Increase mixer speed. Slowly add Ucar 175. Add Mazon R17A. Adjust to pH=7.00 with Triethanolamine.

Charge a 202×700 50 lb/25 lb tinplate aerosol container with 34.2 grams of the above blended concentrate. Add 180.8 grams of Dimethyl Ether propellant to a pressure of 63.0–80.0 psig.

Commercial Sources a. Union Carbide Corporation (Danbury, Conn.)
b. National Starch and Chemical Corporation (Bridgewater, N.J.)
c. Union Camp Corporation (Wayne, N.J.)
d. Rohm and Haas (Philadelphia, Pa.)
e. E. I. Dupont de NeMours & Company (Wilmington, Del.)
f. Exxon Corporation (Houston, Texas)
g. Borden Chemical (Columbus, Oh.)
h. Ashland Chemical Company (Columbus, Oh.)
i. Amoco Chemicals Company (Chicago, Ill.)
j. Sandoz Chemicals Corporation (Charlotte, N.C.)
k. Aeropres Corporation (Sibley, La.)
l. EM Industries (Cherry Hill, N.J.)
m. Goodyear Tire & Rubber Company (Akron, Oh.)
o. Mazer Chemicals, Inc. (Gurnee, Ill.)

Use of Aerosol Formulations

Use of the foregoing aerosol formulations can be illustrated in relation to the spraying of a paper towel, which is a preferred, readily available substrate. One hand may be covered with a sheet of clean, dry paper towel, and the aerosol container held upright at about 8 to 10 inches from the towel sheet. Spraying may be carried out with a circular motion, the spraying being for about 2 to 4 seconds. Following spraying, the towel sheet is held for about 10 to 20 seconds before use, such as about 15 seconds. The sprayed side of the sheet is then used by patting it against the garment or other fabric item to lift hair, lint, etc. It is desirable to avoid wiping the fabric with the sprayed sheet. If needed, the same towel surface can be resprayed to accomplish additional or more complete removal of particulate material, providing the same spray procedure is used and the spraying is not continued or repeated until a continuous coating is formed on the sheet.

We claim:

1. The method of removing lint, hair, and other particulate matter from fabric, comprising:

(a) preparing a sprayable adhesive composition in a valve-equipped aerosol container, said composition comprising an adhesive film-forming resin in admixture with a tackifier or plasticizer and an aerosol propellant in which said resin is soluble or dispersible, said propellant having a vapor pressure of 10 psig or higher at 70° F.;

(b) spraying said composition from said container onto flexible sheet material which has an essentially non-shedding surface for receiving the spray, said spraying being carried out so as to splatter said surface with tacky adherent globules of the tackified or plasticized resin without forming a continuous coating on said surface; and (c) as soon as said globules are substantially free of said propellant contacting the sprayed surface of the sheet material to the fabric from which the particulate matter is to be removed.

2. The method of claim 1 in which said resin is an acrylic polymer or copolymer.

3. The method of claim 1 or claim 2 in which said propellant is dimethyl ether.

4. The method of claim 1 or claim 2 in which said propellant is a mixture of dimethyl ether and a hydrocarbon propellant.

5. The method of claim 1 or claim 2 in which said propellant is a mixture of dimethyl ether and n-butane.

6. The method of claim 1 in which said spraying is carried out in about 1 to 5 seconds for up to each square foot of sprayed area.

7. The method of claim 1 or claim 3 in which said sheet material is contacted with said garment in less than 60 seconds after said globules are formed thereon.

8. The method of claim 1 in which said resin is an aqueous acrylic polymer emulsion.

9. The method of claim 1 in which said composition is essentially anhydrous, said resin is an acrylic polymer, said tackifier is a modified acrylic resin, and said propellant is dimethyl ether.

10. The method of removing hair, lint, and other particulate matter from fabric, comprising:

(a) preparing a sprayable adhesive composition in a valve-equipped aerosol container, said composition comprising an acrylic polymer in admixture with a tackifier or plasticizer and an aerosol propellant selected from the group consisting of dimethyl ether and mixtures of dimethyl ether with a hydrocarbon propellant selected from the group consisting of n-butane, isobutane, propane, and mixtures thereof;

(b) spraying said composition from said container onto a flexible sheet of up to about one square foot in area, said sheet providing an essentially non-shedding surface for receiving the spray, said spraying being carried out so as to splatter said surface with tacky adherent globules of the tackified or plasticized polymer without forming a continuous coating on said surface, the duration of said spraying being from about 1 to 5 seconds; and (c) in not over 30 to 60 seconds after said globules are formed on said surface contacting the sprayed surface of said sheet with fabric from which the particulate matter is to be removed.

11. The method of claim 10 in which said acrylic polymer is in the form of an aqueous emulsion.

12. The method of claim 10 in which said composition is essentially anhydrous, said resin is an acrylic polymer, said tackifier is a modified acrylic polymer, and said propellant is dimethyl ether.

13. The method of claims 1, 2, 10, 11, or 12 in which said sheet material is a paper towel.

14. The method of claims 1, 2, 10, 11, or 12 in which said sheet material is a plastic sheet or bag.

15. The method of claims 1, 2, 10, 11, or 12 in which said sheet material is cloth.

16. The method of claim 1 or claim 10 in which said composition includes a surfactant to promote water-washability of the sprayed composition.

17. The method of claim 1 or claim 10 in which said spraying is carried out in about 2 to 4 seconds, and said contacting of the sprayed surface with said fabric is carried out in about 10 to 30 seconds after said spraying.

* * * * *